United States Patent [19]

Hofmann et al.

[11] 4,197,721

[45] Apr. 15, 1980

[54] METHOD FOR FORMING OF STITCHES AND KNITTING MACHINE FOR CARRYING OUT THE METHOD

[76] Inventors: Ulrich Hofmann, Goethestr. 99, 7470 Ebingen, Fed. Rep. of Germany; Lothar Thomma, Burenweg 281, Hochwald (Kanton Solothurn), Switzerland

[21] Appl. No.: 843,658

[22] Filed: Oct. 19, 1977

[30] Foreign Application Priority Data

Oct. 19, 1976 [DE] Fed. Rep. of Germany ..... 2647185

[51] Int. Cl.[2] ..... D04B 9/06; D04B 35/02

[52] U.S. Cl. ..... 66/19; 66/13; 66/90; 66/116; 66/203

[58] Field of Search ..... 66/7, 8, 13, 90, 116, 66/19

[56] References Cited

U.S. PATENT DOCUMENTS

| | | | |
|---|---|---|---|
| Re. 15,741 | 1/1924 | Scott | 66/13 |
| 440,415 | 11/1890 | Bridges | 66/8 UX |
| 2,560,872 | 7/1951 | Pares et al. | 66/116 X |
| 2,685,785 | 8/1954 | Capdevila | 66/13 |
| 3,527,065 | 9/1970 | Peberdy | 66/90 X |
| 3,983,719 | 10/1976 | Rich et al. | 66/13 X |

FOREIGN PATENT DOCUMENTS

| | | | |
|---|---|---|---|
| 87490 | 7/1896 | Fed. Rep. of Germany | 66/90 |
| 591693 | 1/1934 | Fed. Rep. of Germany | 66/90 |

*Primary Examiner*—Wm. Carter Reynolds
*Attorney, Agent, or Firm*—Shlesinger, Arkwright, Garvey & Dinsmore

[57] ABSTRACT

A method and apparatus for mechanical stitch formation with at least one continuous yarn or thread wherein a loop of yarn or thread is provided around a stitch forming needle, and this first loop is clamped at its distal end so as to be retained around the needle while the thread is drawn through this first loop so as to form a second loop engaging the first loop, whereupon the first loop is released and cast off of the needle while the needle passes through the second loop which is then clamped around the needle in preparation for a repeat operation for formation of successive stitches.

17 Claims, 17 Drawing Figures

24
10
13
11
17
8
12
19
16
10
11

18

8
9
14
14'

8

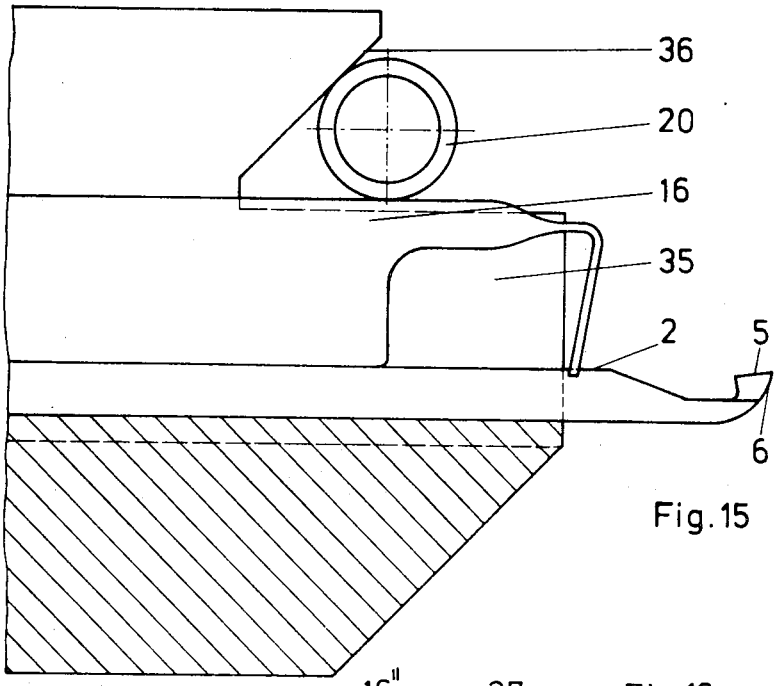
Fig.15
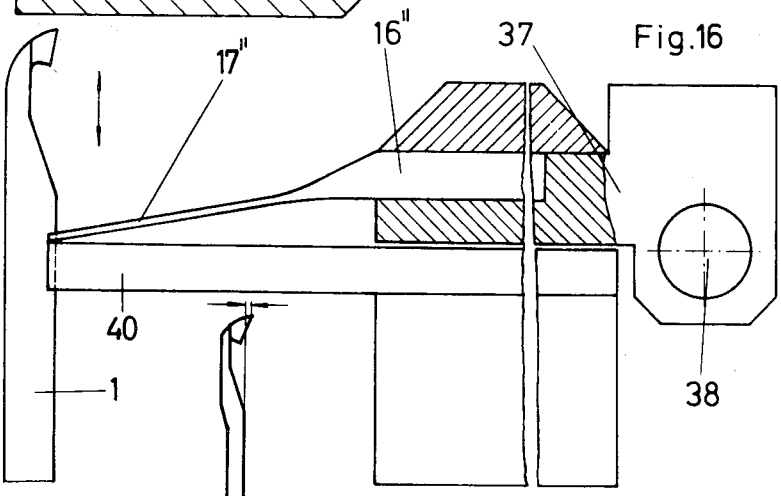
Fig.16
Fig.17

METHOD FOR FORMING OF STITCHES AND KNITTING MACHINE FOR CARRYING OUT THE METHOD

The invention relates to a new stitch forming method, wherein on the one hand the stitch forming elements of a knitting machine still form only extremely short strokes, but wherein on the other hand very small loops and thus very fine stitches can be made. The method guarantees a simple feed of the yarn to the stitch forming elements and a sure drawing of the new yarn in loop formation through the preceding stitch, without enlarging this preceding stitch.

In carrying out the method on circular or straight knitting machines, a stitch forming needle and a controlled clamp device work together, by which the preceding stitch is held fast for a short time for penetration and drawing through of the new yarn. The needle consists of the penetration element, a retaining segment for the preceding stitch, and a slip surface to move the old stitch away. Before the end of the penetration process, the old stitch can slip on through openings of the clamp device in the direction of the finished stitch, so that it is brought forward by the subsequent thrust of the needle, of which the slip surface is brought behind the new stitch, and without being freed, reaches the supporting segment.

The clamp device must be such that the last stitch is held securely even when the finest yarns are used. According to the invention, this is attained by an independent spring action of the clamp element, which compensates for differences of tolerance in the clamp element during its movement and differences of the yarn thickness.

In one embodiment, the clamp device consists of a stationary clamp block at the height of the edge of the stitch making assembly and a clamp part which moves relative to it, which presses in synchronization on the clamp surface of the block, and engages somewhat around the retainer segment of the needle, or engages in a longitudinal groove of the needle. The movement for clamping and unclamping the clamp part can occur parallel to the direction of movement of the needle by means of a control foot or in a rocker coupling arrangement. The clamp part preferably ends in a spring part which acts on the clamp surface.

The particularly short strokes of the stitch forming elements in the machine provide that, as opposed to the present state of technology, no latch needles are used, by which a double size stroke is necessary between the highest point for the pickup of the new yarn (at which time the preceding stitch slips over the opened latch onto the needle shaft) and the lowest point for throwing off of the preceding stitch.

Mechanical embodiments and devices are described in the following in connection with the drawings.

FIG. 15 shows a perpendicular cross section through the outside edge of a rib plate of a circular knitting machine for use in the method of the invention.

FIG. 16 shows use of the method with a loop sinking hosiery machine or a chain stitch machine.

FIG. 17 shows a preferred embodiment of a needle according to the invention.

Figure 1:
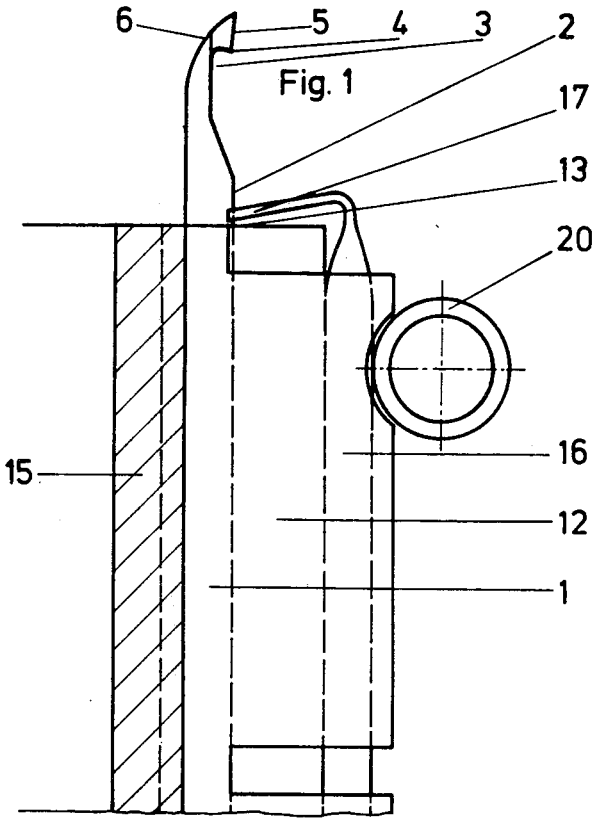
FIG. 1 shows an enlarged cross section through the needle cylinder of a knitting machine with needles and clamp device according to the invention.

FIG. 1 shows the cylinder 15 of a circular knitting machine as in the invention, in the circumference of which are arranged a series of vertical needle passages. A needle or stitch forming element 1 is led through the passages, and above the cylinder is found the bedplate block 12, provided with surfaces 13, and beyond and above that the clamp element 16 with clamp spring portion 17 bent toward the needle 1. Needle 1 has a retaining segment 2 in the forward (outside) area for the last stitch, a top yarn space 3 and at the top end a thrust element 4 with a downward and slightly inward inclined straight edge 5, as well as sloping rear slip edge 6. At the bottom or rear part of needle 1 and clamp 16 is found a control foot, for example 18 (FIG. 9), whereby the control feet projecting out of the needle passages are relatively movable in relation to the cylinder 15, in order to move the needle and clamp up and down in precisely synchronized time pattern. A helical spring 20 mounted on the circumference of the cylinder or a stationary guide ring guarantees that block surface 13 and clamp spring portion 17 engage consistently exactly on the surface of retaining segment 2.

Figures 4, 5, 6, 7, 8, 9, 10:
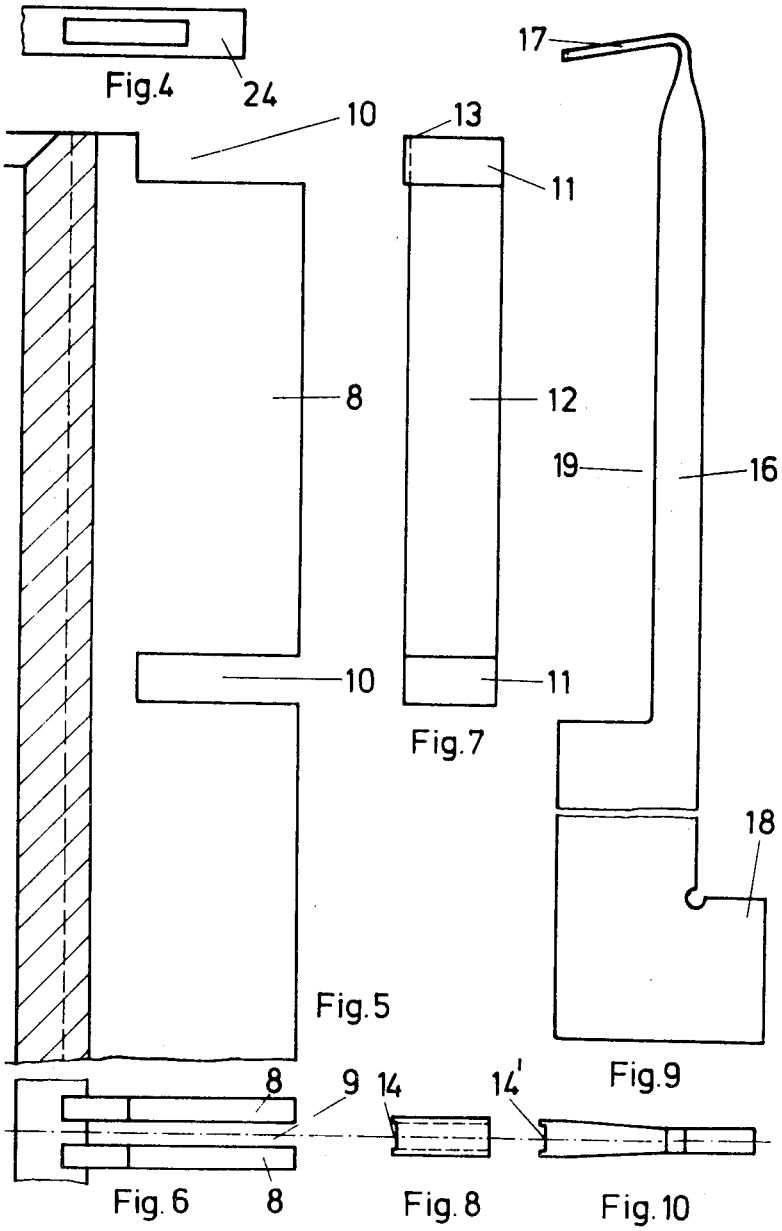
FIG. 4 shows a top plan view of a slide plate for use with the arrangement of FIGS. 2, 3.
FIGS. 5 and 6 show an elevation view and a top plan view of a segment cutout of the needle cylinder of a circular knitting machine.
FIGS. 7 and 8 show an elevation view and a top plan view of a bedplate block.
FIGS. 9 and 10 show an elevation view and a top plan view of a clamp which cooperates with the block of FIG. 7.

FIGS. 5 and 6 show a greatly enlarged segment cut out of a needle cylinder 15 of a circular knitting machine, with two bars 8, between which is found a needle passage 9 with breadth corresponding to the shaft thickness of needle body 1. Bars 8 have notches 10, which receive thickenings 11 of an elongated block or anvil member 12. On the top surface of top thickening 11 is found, in FIG. 7, a block or anvil surface 13, while the inner longitudinal side of the thickening in FIG. 8 has a notch 14, which spans retainer segment 2 of needle 1.

Clamp 16 as in FIGS. 9 and 10 has a clamp spring 17 with a notch 14' identical to the clamp block, and on the bottom segment a control foot 18. In the rear clearance 19 of clamp 16 is found block 12.

Figure 2:
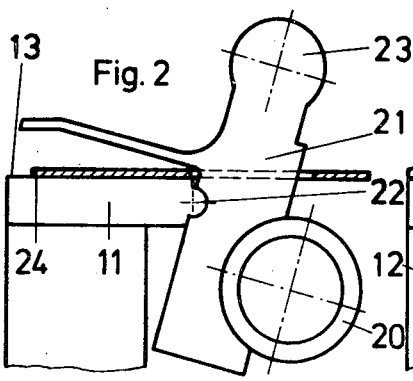
FIGS. 2 and 3 show diagrammatic side views another embodiment of a clamp device with rocker coupling in release position and in clamped position.
Figure 3:
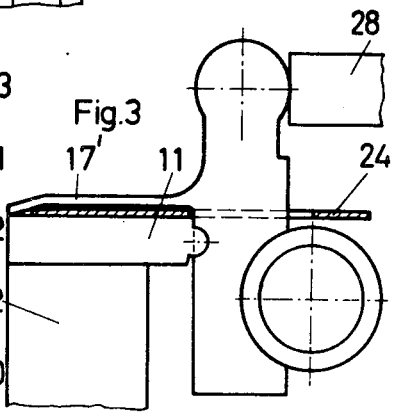

FIGS. 2–4 show an alternative embodiment including a clamp device with rocker coupling arrangement of controlled clamp part 21. The top thickening 11 of block 12 is provided with a bearing 22. Instead of the indicated rocker coupling, the movable clamp can be received in a slot of the broadened block 12, and be attached by means of a pin. In this case, block and clamp spring are a prefabricated unit. The helical spring 20, as shown in FIG. 1 mounted around the clamp body, serves for setting of clamp spring 17' and block surface 13 directly on retainer segment 2 of the needle, and serves simultaneously for opening of the clamp into rest position. The clamping of the switch while resting on anvil surface 13 is controlled by a cam disk 28 of the needle bolt mounted stationary opposite the rotating needle cylinder, on which lies the top control foot 23. To move the stitch clamped on surface 13 away, a controlled slide 24 (FIG. 4) can be provided, through the opening or slot of which projects the top segment of clamp part 21.

Because of the very short strokes, it is possible to construct the needles also as a notched plate, which is moved radially around a pivot point beyond the bearing of the clamp device, instead of being guided in longitudinal passage. This results in a good space-saving arrangement, which is advantageous especially with small diameters of rib plates.

On the other hand it is possible to construct the block body not as a separate part, but rather as a ring mounted around the needle cylinder, of which the inner diameter fits directly on the top edge of retainer segment 2. Clamp spring 17 then locks with the top edge of retainer segment 2 without notch 14, or else engages in a longitudinal groove of the retainer segment.

The invention described in the examples is applied to a circular knitting machine; its use is however analogous with straight knitting machines. In this case, a simple bar is used instead of a ring mounted around the needle cylinder.

Figure 11:
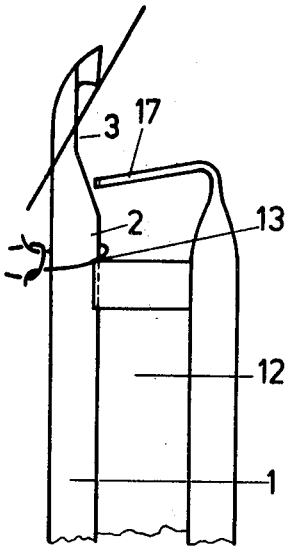
FIGS. 11 to 14 show steps of the method of stitch formation according to the invention.
Figure 12:
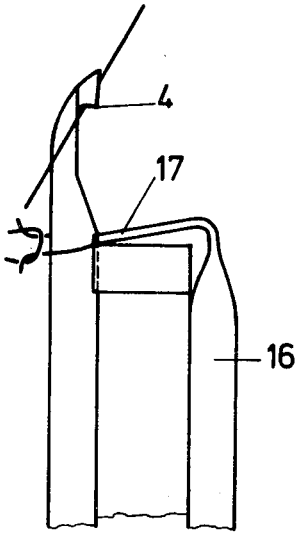

FIGS. 11–14 depict the most important steps of the method. In FIG. 11, a yarn loop on retainer segment or shank portion 2 over block body 12, and the new yarn is inserted in the yarn space 3 which is open on one side. In FIG. 12, the new yarn is trapped by the thrust element or hook portion 4 by drawing back of needle 1, and remains in the yarn space. During the return movement, the resilient clamp portion of spring part 17 clamps the distal end or at least one portion of the circumferential length of the yarn loop remote from the preceeding or cast loop.

Figure 13:
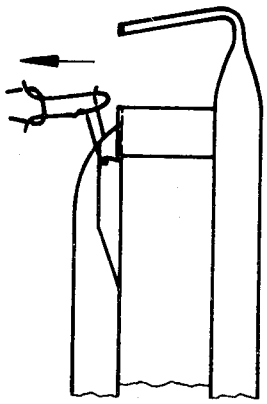

FIG. 13 shows the new yarn as a loop being driven through and intermeshing the stitch which is being held open by the clamping during retraction movement of the needle 1 whereupon clamp spring 17 is raised, so that the existing stitch or loop can be cast off and slip somewhat away to the left in the direction of the arrow, for removal, and thus is freed from clamp surface 13.

Figure 14:
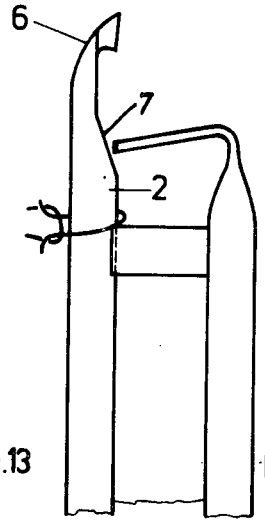

During the forward movement of needle 1, as in FIG. 14, the freed stitch or cast loop slips over the curved slip edge 6 to the rear of the needle, and the yarn loop forming the new stitch over the inclined surface 7 to retainer segment 2, whereby it is brought into the clamp position.

FIG. 15 shows an enlarged representation of a vertical cross section through the outer circumference of a rib plate in which the crosspiece 35 bordering the needle passages on the side has an upper inclined contact surface 36, on which fits a biased helical spring 20, which lies on the top edge of clamp part 16, so that a sure contact occurs between the needles sliding in series and the clamp springs. Obviously the rib plate forms an additional work unit in a circular knitting machine, which rotates as the needle cylinder with the stitch forming elements opposite a stationary lock curve, in order to produce doubleknit articles.

FIG. 15 shows the possibility of deleting a block surface and clamping the stitch on the top edge of crosspiece 35. The clamping occurs here on crosspiece 35 on both sides of retainer segment 2, so that the stitch has a not-clamped stitch section between the two side clamped areas.

The inwardly inclined edge 5 of needle 1 can lie partially forward of the straight line leading edge of retainer segment 2, so that with the pulling through process, the not-clamped section of the stitch is expanded corresponding, corresponding to the inclination of edge 5 slightly due, and again contracts after it passes completely by the edge. After freeing of the clamp, the stitch proceeds with the forward movement of the needle even without the aid of thruster devices or repelling plates onto slip curve 6. One embodiment for that purpose, which is suitable for production of the finest stitches, is shown 10 times enlarged in FIG. 17.

For hoisiery work and chain stitch machines, the invention can be applied as in FIG. 16. Here, neeles 1 are inserted with their rear shaft parts in a needle bar (not shown), and are moved up and down together for formation of stitches. The clamps 16' are inserted in a second needle bar 37, which is pivotable around an axis 38, whereby all old stitches are released from clamping simultaneously onto a bar 40. As is customary, plates and eye-pointed needles are used for sinking the loops and the new yarn, and for guiding the warp beam yarn.

Although the smallest stitches are intended, the invention is not automatically limited to the stitch formation elements shown. It also extends to needles with folded over hooks, with which thicker stitches or stitches with more fiber can be produced.

The basis of the invention is the method for a new type of stitch formation, by which the immediate preceding stitch and the needle closely surrounded by the stitch are held tightly or clamped in this state while the longitudinal freedom of movement of the needle is maintained, and in which a yarn for formation of a new stitch is thrust or pushed through the stitch formed immediately preceding, and the stitch formed immediately preceding is freed at that moment when the yarn for the next stitch is thrust into the area of the plane of the precedingly formed stitch. Thus, the enlargement of the stitch can be limited to the circumference of the needle body, and therefore a fine-loop stitch can be produced, as opposed to known methods, in which the stitch formed precedingly must undergo a greater enlargement, so that in the case of a latch needle, they slip out of the previously closed yarn space over the opened hook onto the needle shaft, and vice versa also with the closed hook wherein they can slip over the closed yarn space and can be thrown off. Even in the case of a spring needle, in which the flexible end is regulated for the opening and closing of the yarn space, the stitch expansion must be sufficiently great that the hook with the inserted new yarn can proceed through. The step of clamping the stitch therefore facilitates a limiting of the size of the stitch to the very small circumference of the needle shaft.

Since the stitch clamping occurs for a brief period, and then is terminated, when the nest yarn attains the level of the old stitch by the thrust process, then extremely short needle strokes are obtained, which lead to reduction of the structural cost, but particularly lead to an increase of the machine synchronization speed.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A method for successive mechanical stitch formation using at least one continuous thread and a stitch forming needle reciprocable adjacent a stationary clamping block comprising providing a first loop surrounding said needle when said needle is extended through said clamping block, clamping said first loop at at least one portion of its circumferential length remote from the preceeding loop so as to retain said first loop around said needle and in the surface plane of said clamping block during retraction movement of said needle through said clamping block by means of a clamp member engegeable said clamping block and movable toward and away from said clamping block or clamping said thread between said clamp member and said clamping block, moving said thread through said first loop by said needle retraction movement so as to form a second loop inermeshing said first loop, releasing said first loop from retention around said needle on said clamping block and extending the needle through said second loop.

2. A method as in claim 1 and including expanding said first loop to a desired final size prior to said clamping step.

3. A method as in claim 2 and including expanding said second loop to a desired final size and repeating said method wherein said second loop becomes a first loop.

4. A stitch forming apparatus for successively forming a plurality of interlocked stitches from at least one continuous thread comprising:

a plurality of stitch forming needles reciprocable in a needle bed, a clamping member associated with each of said needles and engageable with and moveable toward and away from a surface portion of said needle for releasably clamping formed loops of thread between clamping members and said first portion and around said needles while succesing loops of thread are being formed.

5. A stitch forming apparatus as in claim 4 and wherein:

said clamping members include a resilient clamp portion.

6. A stitch forming apparatus as in claim 5 and wherein:

said needles each include a hook portion for engaging said thread and a curved slip edge rearwardly of said hook portion for deflecting loops cast off of said needle in a direction away from said clamping members;

said curved slip edge terminating at an intersection with a planar frontal surface inwardly inclined toward the shank of said needle, said intersection forming the tip of said needle.

7. A stitch forming apparatus in claim 6 wherein:

the lateral distance between said back of said needle and the tip of said needle is greater than the width of that portion of said needle around which said loops are clamped.

8. A stitch forming apparatus as in claim 4 and wherein:

said clamping members include shank portions guided in grooves in said needle bed.

9. A stitch forming apparatus as in claim 8 and wherein:

said clamping members include a clamp spring portion bent toward said needle.

10. A stitch forming apparatus as in claim 9 and wherein:

said clamping members include recesses conforming to the profile of said needles.

11. A stitch forming apparatus as in claim 10 and wherein:

said recesses are formed by a bifurcation in the distal end of said clamp spring portion.

12. A stitch forming apparatus as in claim 9 and wherein:

said needles include a shank portion including a recess therein, and said clamp spring portions are engageable with said recesses.

13. A stitch forming apparatus as in claim 4 and wherein:

said needle bed includes grooves formed therein for receiving said needles, anvil members positioned in said grooves adjacent said needles and having said surface portions formed thereon.

14. A stitch forming apparatus as in claim 4 and wherein:

said clamping members are reciprocable between clamping and releasing positions.

15. A stitch forming apparatus as in claim 4 and wherein:

said clamping members are pivotable between clamping and releasing positions.

16. A stitch forming apparatus as in claim 15 and wherein:

said clamping members include clamp spring portions extending away from the pivot point toward said needle.

17. A stitch forming apparatus as in claim 15 and including:

spring means urging said clamping members toward said releasing positions.

* * * * *